US011569556B2

(12) United States Patent
Min et al.

(10) Patent No.: US 11,569,556 B2
(45) Date of Patent: Jan. 31, 2023

(54) PHASE SHIFTER COMPRISING DGS AND RADIO COMMUNICATION MODULE COMPRISING SAME

(71) Applicants: LG Display Co., Ltd., Seoul (KR); UIF (UNIVERSITY INDUSTRY FOUNDATION), YONSEI UNIVERSITY, Seoul (KR)

(72) Inventors: Byungwook Min, Seoul (KR); Hoon Bae Kim, Paju-si (KR); Sung-Eun Kim, Seoul (KR); Jeong Min Moon, Paju-si (KR); Su Seok Choi, Paju-si (KR); Sungpil Ryu, Paju-si (KR); Jihwan Jung, Paju-si (KR); Kiseok Chang, Paju-si (KR)

(73) Assignees: LG DISPLAY CO., LTD., Seoul (KR); UIF (UNIVERSITY INDUSTRY FOUNDATION), YONSEI UNIVERSITY, Seoul (KR)

( * ) Notice: Subject to any disclaimer, the term of this patent is extended or adjusted under 35 U.S.C. 154(b) by 252 days.

(21) Appl. No.: 16/762,047

(22) PCT Filed: Oct. 23, 2018

(86) PCT No.: PCT/KR2018/012525
§ 371 (c)(1),
(2) Date: May 6, 2020

(87) PCT Pub. No.: WO2019/088542
PCT Pub. Date: May 9, 2019

(65) Prior Publication Data

US 2020/0274217 A1 Aug. 27, 2020

(30) Foreign Application Priority Data

Nov. 6, 2017 (KR) ..... 10-2017-0146594

(51) Int. Cl.
*H01Q 3/36* (2006.01)
*H01P 1/18* (2006.01)
(Continued)

(52) U.S. Cl.
CPC ..... *H01P 1/184* (2013.01); *H01P 3/08* (2013.01); *H01Q 1/50* (2013.01)

(58) Field of Classification Search
CPC .... H01P 1/184; H01P 3/08; H01P 1/18; H01P 3/081; H01Q 1/38; H01Q 1/48;
(Continued)

(56) References Cited

U.S. PATENT DOCUMENTS 4,035,807 A * 7/1977 Tang ..... H01Q 3/38 343/768
4,305,052 A * 12/1981 Baril ..... H01P 1/185 333/164
(Continued)

FOREIGN PATENT DOCUMENTS

CN 106450722 A 2/2017
JP 2000-278012 A 10/2000
(Continued)

OTHER PUBLICATIONS

Office Action dated Mar. 29, 2021 issued in Chinese Patent Application No. 201880071761.2 with English translation (15 pages).
(Continued)

*Primary Examiner* — Tho G Phan
(74) *Attorney, Agent, or Firm* — Polsinelli PC

(57) ABSTRACT

A phase shifter includes a first substrate; a microstrip formed on the first substrate so as to extend in a first direction; a ground layer disposed with a space on the upper surface of the microstrip and having a defected ground structure (DGS) with a defected pattern formed therein; a second substrate disposed on the ground layer; and a liquid crystal layer
(Continued)

disposed in a space between the first substrate and the second substrate, wherein DC voltage is applied between the ground layer and the microstrip.

20 Claims, 10 Drawing Sheets

(51) Int. Cl.
*H01P 3/08* (2006.01)
*H01Q 1/50* (2006.01)

(58) Field of Classification Search
CPC .. H01Q 1/50; H01Q 3/26; H01Q 3/36; H01Q 21/06; H01Q 21/22
See application file for complete search history.

(56) References Cited

U.S. PATENT DOCUMENTS 6,356,166 B1 * 3/2002 Goldsmith ..... H05K 1/0251 342/368
6,538,603 B1 * 3/2003 Chen ..... H01Q 3/36 342/372
7,623,008 B2 * 11/2009 Murano ..... H01P 1/184 333/161
8,570,114 B2 * 10/2013 Wu ..... H01P 1/2039 343/909
10,826,180 B2 * 11/2020 Hong ..... H01Q 9/0414
11,233,301 B2 * 1/2022 Wang ..... H01Q 1/22
2012/0057323 A1 3/2012 Wu et al.
2014/0022029 A1 1/2014 Glushchenko et al.

FOREIGN PATENT DOCUMENTS

JP 2006019855 A 1/2006
KR 10-0623517 B1 9/2006
KR 10-1040426 B1 12/2010
KR 10-2011-0102756 A 9/2011
KR 10-1530964 B1 6/2015

OTHER PUBLICATIONS

R. A. Pandhare, et al., "Beam-steering in microstrip patch antenna array using DGS based phase shifters at 5.2 GHz", 2015 International Conference on Information Processing (ICIP), Nov. 19, 2015, p. 239-243.
Girae Kim, "Minimizing Design of the Schiffman Phase Shifter Using the Defected Ground Structure", DBPIA, Journal of the Korea Institute of Information and Communication Engineeering 2009.9, 1745-1752.

* cited by examiner

PHASE SHIFTER COMPRISING DGS AND RADIO COMMUNICATION MODULE COMPRISING SAME

CROSS REFERENCE TO RELATED APPLICATIONS

This application is a National Stage of Patent Application No. PCT/KR2018/012525 filed on Oct. 23, 2018, which claims priority from Korean Patent Application No. 10-2017-0146594 filed on Nov. 6, 2017, which are hereby incorporated by reference in their entirety.

BACKGROUND

Field of the Disclosure

The present disclosure relates to a phase shifter including a defected ground structure (DGS) and an electromagnetic-wave communication module including the same.

Description of the Background

A microstrip transmission line structure has been widely used as a transmission line structure for implementing RF communication circuits and components based on a radio frequency (RF) band, a microwave band, and a millimeter wave band. The microstrip transmission line is generally formed in a planar structure on a printed circuit board (PCB). In the microstrip transmission line, generally, a defected ground structure (DGS) is formed in a ground plane via etching.

Generally, when the defect ground structure (DGS) is inserted into the transmission line, a length of the microstrip transmission line can be reduced. This can reduce a length of a RF communication circuit. However, even when the defect ground structure (DGS) is inserted into the ground plane of the microstrip transmission line, there is a limit in reducing the length of the microstrip transmission line while maintaining a desired electrical performance.

Further, a phase shifter is used which changes a phase of the transmission line using property that a dielectric constant of dielectric varies depending on an applied voltage thereto. The phase shifter has dielectric between an upper electrode and a lower electrode and changes the phase of the transmission line by adjusting the dielectric constant of the dielectric under control of a voltage applied to the upper electrode and the lower electrode. In a conventional phase shifter, when the voltage applied to the upper electrode and the lower electrode increases, a relative dielectric constant of the dielectric decreases. Thus, a propagation constant is reduced to control the phase of the transmission line.

However, the conventional phase shifter has a relatively large dielectric thickness and a large insertion loss. This requires a high voltage to be applied thereto for a phase change by about 360 degrees.

SUMMARY

The present disclosure provides a phase shifter including a thin liquid crystal layer to sufficiently change a phase of a transmission line using a relatively small applied voltage thereto, and to provide an electromagnetic-wave communication module including the phase shifter.

In addition, the present disclosure provides an electromagnetic-wave communication module in which a phase shifter therein realizes a wide bandwidth so that an overall bandwidth of the communication module is not limited by the phase shifter.

The present disclosure is not limited to the above-mentioned purposes. Other purposes and advantages of the present disclosure, as not mentioned above, may be understood from the following descriptions and more clearly understood from the aspects of the present disclosure. Further, it will be readily appreciated that the objects and advantages of the present disclosure may be realized by features and combinations thereof as disclosed in the claims.

In one aspect of the present disclosure, there is provided a phase shifter comprising: a first substrate; a microstrip disposed above the first substrate to extend in a first direction; a ground layer disposed above the microstrip and spaced from the microstrip, wherein the ground layer includes a defected ground structure (DGS) by forming a defected pattern therein; a second substrate disposed above the ground layer; and a liquid-crystal layer disposed in a space between the first substrate and the second substrate, wherein a direct current (DC) voltage is applied to between the ground layer and the microstrip.

Further, the liquid crystal layer includes a liquid crystal material whose dielectric constant changes based on a magnitude of the DC voltage applied to between the ground layer and the microstrip.

Further, the defected ground structure includes at least one opening which is overlapped with the microstrip and defined via etching.

Further, the microstrip is positioned at a center of the opening.

Further, a width of the opening measured in a second direction intersecting with the first direction is greater than a width of the microstrip measured in the second direction.

Further, at least two opening are arranged to be spaced from each other at a regular interval in the ground layer.

Further, each of the first substrate and the second substrate include a glass substrate.

Further, the ground layer is made of a metal material including copper.

In another aspect of the present disclosure, there is provided an electromagnetic wave communication module comprising: an antenna array for transmitting and receiving an electromagnetic wave; a phase shifter for transmitting a transmitted signal of an alternate current (AC) voltage to the antenna array, wherein the phase shifter is configured to change a phase of the transmitted signal; and a voltage controller configured to control a magnitude of a DC voltage applied to the phase shifter, wherein the phase shifter includes: a first substrate; a microstrip disposed above the first substrate to extend in a first direction; a ground layer disposed above the microstrip and spaced from the microstrip, wherein the ground layer includes a defected ground structure (DGS) therein; a second substrate disposed above the ground layer; and a liquid-crystal layer disposed in a space between the first substrate and the second substrate, wherein the voltage controller is configured to apply the direct current (DC) voltage to between the ground layer and the microstrip.

Further, the electromagnetic wave communication module further comprises a power distributor for receiving a transmitted signal from a DC blocker for removing a DC voltage component and for distributing the transmitted signal free of the DC voltage component to a plurality of the phase shifters.

Further, the liquid-crystal layer includes a material whose dielectric constant varies according to a magnitude of the DC voltage applied to between the ground layer and the micro strip.

Each of the phase shifter and the electromagnetic-wave communication module including the phase shifter according to the present disclosure includes the thin liquid crystal layer. Thus, a thickness of the phase shifter can be reduced. Further, a production cost thereof can be reduced using a small amount of liquid crystal.

Further, each of the phase shifter and the electromagnetic-wave communication module including the phase shifter according to the present disclosure sufficiently adjusts a phase using a low voltage applied thereto and further lowers a signal loss. Thus, this may improve performance and efficiency of the phase shifter.

Furthermore, the phase shifter according to the present disclosure realizes a wide bandwidth, such that the overall bandwidth of the communication module is not limited by the phase shifter. Thus, a degree of freedom of a chip design can be increased, and a design cost can be reduced.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTION

Figure 1:
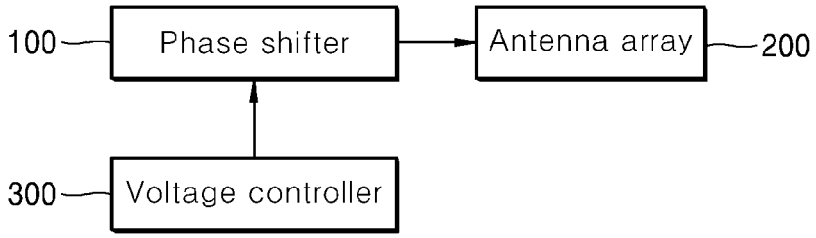
FIG. 1 is a schematic block diagram of an electromagnetic-wave communication module including a phase shifter according to one aspect of the present disclosure.

The above objects, features and advantages will be described in detail with reference to the accompanying drawings. Thus, those skilled in the art to which the present disclosure belongs will be able to easily carry out technical ideas according to the present disclosure. However, it will be understood that the present disclosure may be practiced without these specific details. In other instances, well-known methods, procedures, components, and circuits have not been described in detail so as not to unnecessarily obscure aspects of the present disclosure. Hereinafter, an aspect according to the present disclosure will be described in detail with reference to the accompanying drawings. In the drawings, the same reference numerals are used to denote the same or similar elements.

Hereinafter, a phase shifter including a DGS structure and an electromagnetic-wave communication module including the same according to some aspects of the present disclosure will be described in detail with reference to FIGS. 1 to 10.

FIG. 1 is a schematic block diagram of an electromagnetic-wave communication module including a phase shifter according to one aspect of the present disclosure.

Referring to FIG. 1, an electromagnetic-wave communication module according to one aspect of the present disclosure includes a phase shifter 100, an antenna array 200, a voltage controller 300, and a signal generator 400.

The phase shifter 100 is inserted in the transmission line to shift a phase of a signal transmitted along the transmission line. In the phase shifter 100, a DC voltage may be applied to between a microstrip (120 in FIG. 3) used as the transmission line and a ground layer (140 in FIG. 3) that includes a defected ground structure (DSG) to shift the phase of the signal passing through the phase shifter 100.

In this connection, a liquid-crystal layer (130 in FIG. 4) may be placed between the microstrip (120 in FIG. 3) and the ground layer (140 in FIG. 3) of the phase shifter 100. The DC voltage DC applied to between the microstrip (120 in FIG. 3) and the ground layer (140 in FIG. 3) is applied to the liquid-crystal layer (130 in FIG. 4) to reduce a dielectric constant of the liquid-crystal layer (130 in FIG. 4).

That is, the phase shifter 100 may change a phase delay amount of the transmitted signal by changing a capacitance of the phase shifter 100, thereby shifting the phase of the transmitted signal. A detailed description of a structure of the phase shifter 100 will be given later.

The antenna array 200 receives a transmitted signal from the phase shifter 100 and generates an electromagnetic wave according to the transmitted signal. The antenna array 200 may include a plurality of antennas, and the plurality of antennas may be arranged in a predetermined pattern. For example, the antenna array 200 may include a plurality of antennas arranged in a grid-pattern at regular intervals, and may be designed to be mounted in one chip. However, this is only an example, and the present disclosure is not limited thereto.

The plurality of antennas included in the antenna array 200 may have various shapes such as spiral shape, straight lines, and curved lines. Further, the plurality of antennas may have different shapes.

The voltage controller 300 applies a DC voltage to the phase shifter 100. One end of the voltage controller 300 is connected to the ground layer (140 in FIG. 3) and the other end thereof is connected to the microstrip (120 in FIG. 3). The voltage controller 300 applies a DC voltage DC to the liquid-crystal layer (130 in FIG. 4) between the ground layer (140 in FIG. 3) and the microstrip (120 in FIG. 3). This changes the dielectric constant of the liquid-crystal layer (130 in FIG. 4).

The voltage controller 300 may be controlled by a controller (not shown) included in the electromagnetic-wave communication module. The controller (not shown) may adjust the magnitude of the DC voltage output from the voltage controller 300 using a control signal to correct a phase error generated in the electromagnetic-wave communication module. In this way, the phase shifter 100 can adjust an angle of the phase as shifted. As a result, the phase shifter 100 can correct the phase error by controlling the phase of the transmitted signal transmitted to the antenna array 200.

Figure 2:
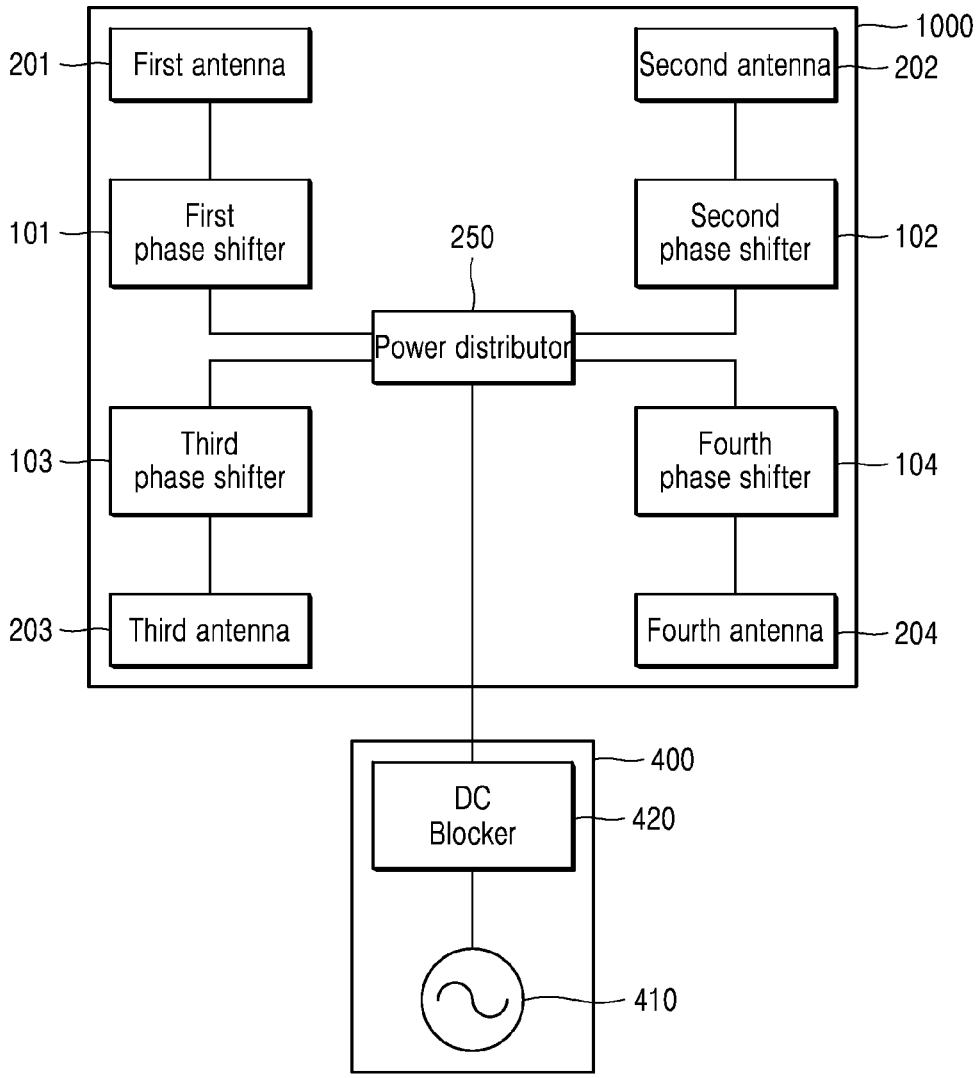
FIG. 2 is a block diagram of an electromagnetic-wave communication module including a phase shifter according to one aspect of the present disclosure.

FIG. 2 is a block diagram of an electromagnetic-wave communication module including a phase shifter according to another aspect according to the present disclosure.

Referring to FIG. 2, an electromagnetic-wave communication module 1000 according to another aspect according to the present disclosure includes a plurality of phase shifters 101, 102, 103 and 104, antenna arrays 201, 202, 203 and 204, and a power distributor 250.

The electromagnetic-wave communication module 1000 receives the transmitted signal of the AC voltage from the signal generator 400. The signal generator 400 includes a signal generation unit 410 and a DC blocker 420.

The signal generation unit 410 generates and transmits a transmitted signal of the AC voltage to the DC blocker 420. However, the signal generated from the signal generation unit 410 may include a noise of a DC voltage component.

In this connection, the DC blocker 420 removes the DC voltage component included in the transmitted signal received from the signal generation unit 410.

The power distributor 250 distributes the transmitted signal received from the DC blocker 420 to the plurality of phase shifters 101, 102, 103 and 104. In this connection, the transmitted signal as distributed contains only the AC voltage component. The transmitted signal may be applied to the microstrip (120 in FIG. 3) of each of the phase shifters 101, 102, 103 and 104, and then be delivered through the liquid-crystal layer (130 in FIG. 4) to each of the antenna arrays 201, 202, 203 and 204 in an electromagnetic-wave form. In this connection, the power distributor 250 may deliver the transmitted signal of the same magnitude to each of the phase shifters 101, 102, 103 and 104.

The phase shifters 101, 102, 103 and 104 and the antenna arrays 201, 202, 203 and 204 may be arranged so as to have a one-to-one correspondence. That is, the same numbers of phase shifters 101, 102, 103 and 104 and antenna arrays 201, 202, 203 and 204 may be included in a single electromagnetic-wave communication module.

Although not clearly shown in the drawing, the voltage controller 300 of FIG. 1 may be connected to the plurality of phase shifters 101, 102, 103 and 104 to apply a DC voltage DC to each of the phase shifters 101, 102, 103 and 104. In this connection, the voltage controller 300 in FIG. 1 may apply the same DC voltage to each of the phase shifters 101, 102, 103 and 104, or apply different DC voltages thereto.

Figure 3:
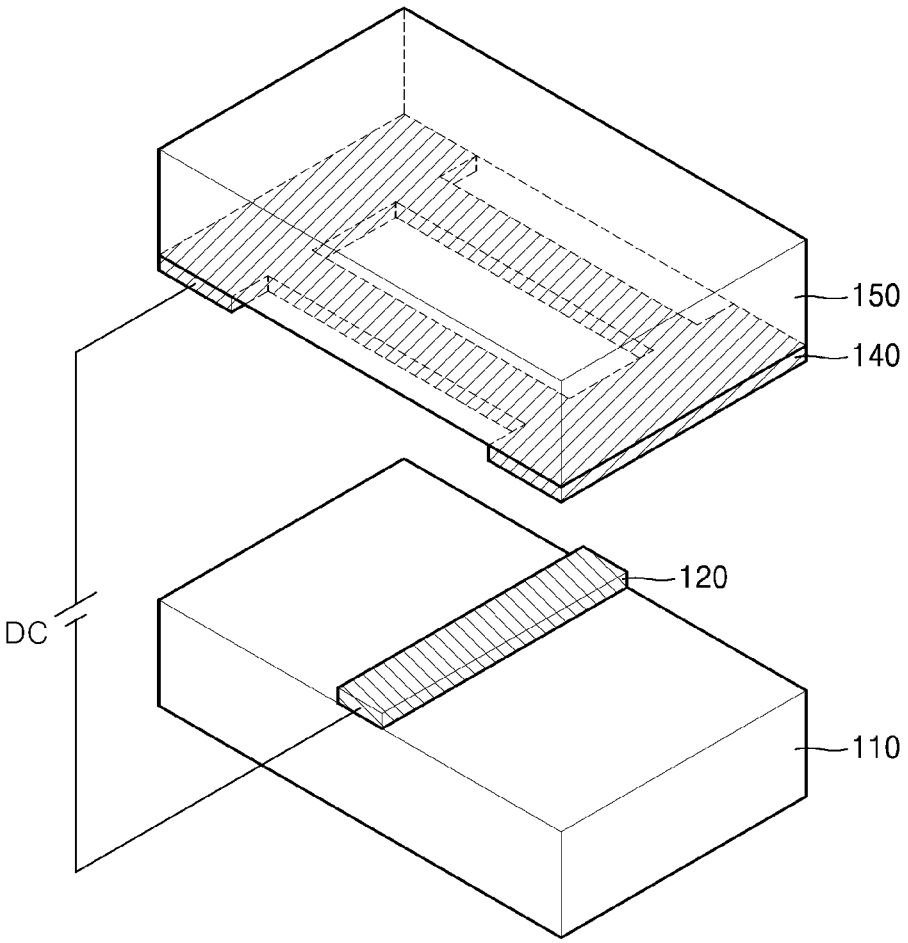
FIG. 3 illustrates a DC voltage applied to a phase shifter according to one aspect of the present disclosure.
Figure 4:
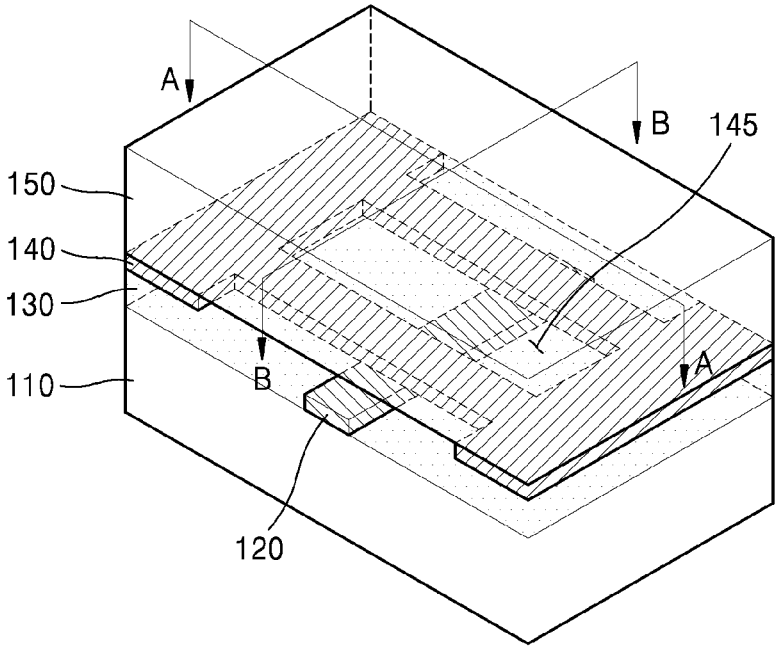
FIG. 4 is a perspective view of a phase shifter according to one aspect of the present disclosure.
Figure 5:
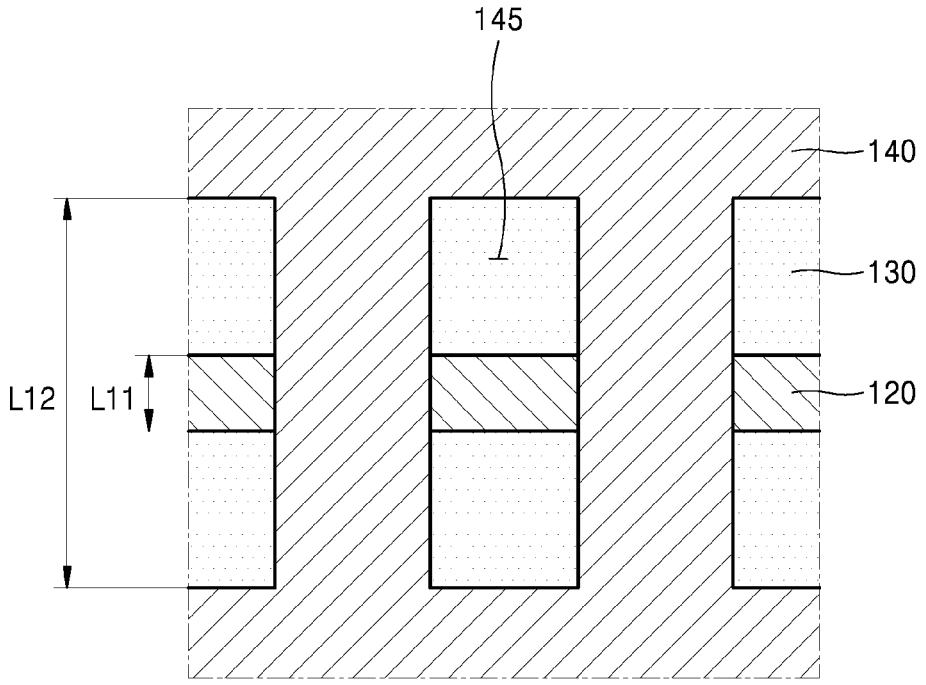
FIG. 5 is a top view of the phase shifter of FIG. 4.
Figure 6:
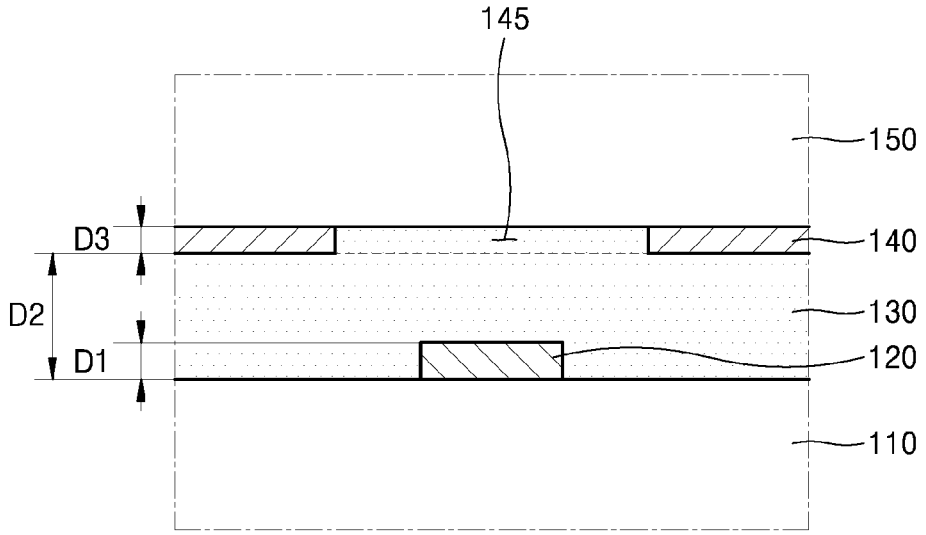
FIG. 6 is a cross-sectional view taken along line A-A of FIG. 4.
Figure 7:
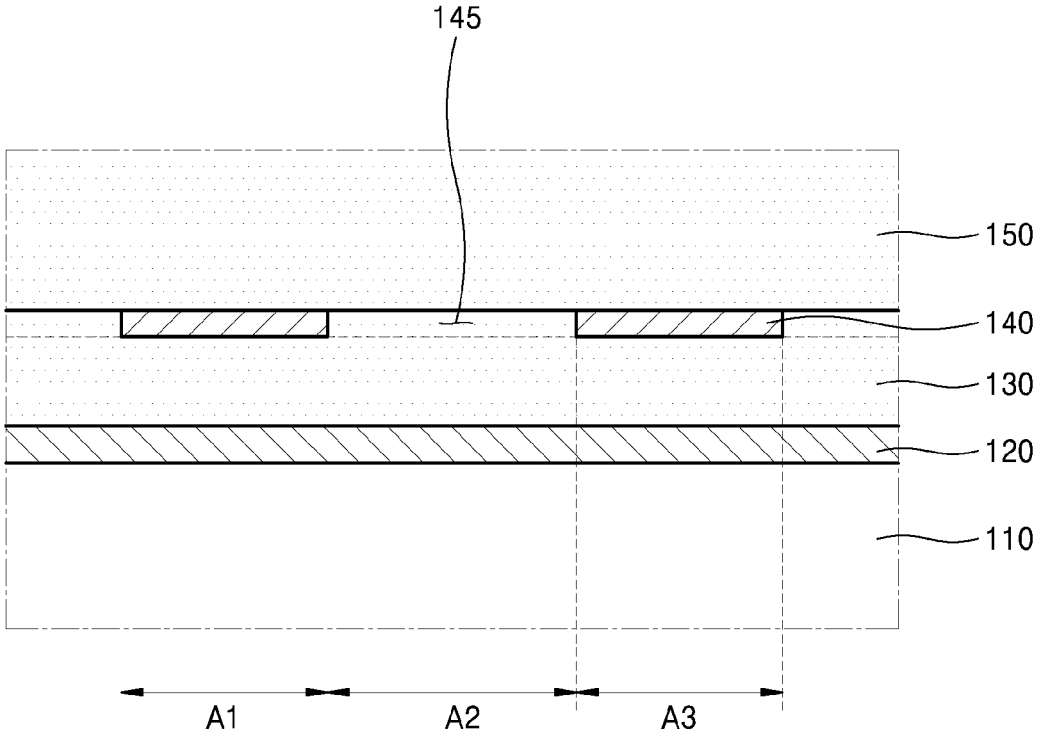
FIG. 7 is a cross-sectional view taken along line B-B of FIG. 4.

FIG. 3 illustrates the DC voltage applied to the phase shifter according to one aspect of the present disclosure. FIG. 4 is a perspective view of a phase shifter according to one aspect of the present disclosure. FIG. 5 is a top view of the phase shifter of FIG. 4. FIG. 6 is a cross-sectional view taken along line A-A of FIG. 4. FIG. 7 is a cross-sectional view taken along line B-B of FIG. 4.

First, referring to FIG. 3 and FIG. 4, a phase shifter in accordance with one aspect of the present disclosure includes a first substrate 110, a microstrip 120, a liquid crystal layer 130, a ground layer 140, and a second substrate 150.

Each of the first substrate 110 and the second substrate 150 may include a semiconductor material, a dielectric material, or a non-conductive material. Each of the first substrate 110 and the second substrate 150 may be embodied as, for example, a semiconductor substrate. Such substrates may include one of silicon, strained silicon (Si), silicon alloy, silicon carbide (SiC), silicon germanium (SiGe), silicon germanium carbide (SiGeC), germanium, germanium alloy, gallium arsenide (GaAs), indium arsenide (InAs), III-V semiconductor, and II-VI semiconductor, combinations thereof, and stacks thereof. Further, if necessary, the substrate may be embodied as an organic plastic substrate rather than the semiconductor substrate, or may be embodied as a glass substrate. In a following description, each of the first substrate 110 and the second substrate 150 is the glass substrate.

The microstrip 120 may be disposed on the first substrate 110 and may be formed to extend in the first direction. A bottom face of the microstrip 120 may be in contact with a top face of the first substrate 110, and side and top faces of the microstrip 120 may be in contact with the liquid crystal layer 130. In the drawing, the microstrip 120 is shown as extending only in the first direction, but the present disclosure is not limited thereto. The microstrip 120 may be formed in a spiral or curved shape on the first substrate 110. Further, although not clearly shown in the drawing, the microstrip 120 may be arranged so as to overlap a patch constituting the antenna array 200.

A portion of the microstrip 120 may be disposed to overlap the ground layer 140. A remaining portion of the microstrip 120 may be disposed to be exposed through an opening 145 defined in the ground layer 140. In this connection, the microstrip 120 may pass through a center of the opening 145 in the ground layer 140. However, the present disclosure is not limited thereto.

The liquid-crystal layer 130 is disposed in a space between the first substrate 110 and the second substrate 150. The liquid-crystal layer 130 covers the top face and sides of the microstrip 120 and fills the space between the first substrate 110 and the second substrate 150 to cover the bottom face and side faces of the ground layer 140. The dielectric constant of the liquid-crystal layer 130 may be changed by a DC voltage applied to between the microstrip 120 and the ground layer 140.

Specifically, the liquid-crystal layer 130 includes a liquid crystal having a dielectric anisotropy. When an electric field is applied to between the first substrate 110 and the second substrate 150, orientation of the liquid crystal changes depending on the magnitude of the electric field, thereby changing the polarization state of the light passing therethrough and thus changing the transmittance and the dielectric constant thereof.

The ground layer 140 includes a defective ground structure (DGS). Specifically, the ground layer 140 includes a plurality of openings 145. The openings 145 overlap the microstrip 120, thereby increasing a magnitude of an inductance L of the transmission line relative to the phase shifter 100.

In this connection, a characteristic impedance Zc of the transmission line is expressed as:

$$Zc = \sqrt{\frac{L}{C}}$$

where L and C represent an inductance and a capacitance per unit length of the transmission line, respectively.

That is, when the number of openings 145 in the ground layer 140 increases and thus the exposed area of the microstrip 120 becomes larger, the inductance L of the phase shifter 100 increases, and the capacitance C thereof decreases. To the contrary, when the number of openings 145 decreases in the ground layer 140 and the exposed area of the microstrip 120 decreases, the capacitance C of the phase shifter 100 increases and the inductance L thereof decreases. Therefore, in the phase shifter 100, the characteristic impedance Zc may be determined based on this trade-off property of the defected ground structure (DGS).

The defected ground structure (DGS) formed in the ground layer 140 increases the electrical length of the transmission line. Thus, the physical length of the phase shifter can be reduced to keep the electrical length of the line to be equal to that before the defected ground structure (DGS) is inserted therein. This principle is called a slow-wave effect. That is, when the defected ground structure (DGS) is inserted into the transmission line, the wave delay effect occurs where the electrical length of the line increases when the same physical length is assumed.

Therefore, the physical length of the phase shifter must be reduced to adapt the electrical length of the transmission line. According to this principle, the defected ground structure (DGS) has the advantage of reducing the physical length of the phase shifter 100 and miniaturizing the circuit.

Further, the ground layer 140 may include a metal material. For example, the ground layer 140 may include a conductive material such as copper or iron. However, the present disclosure is not limited to this material.

Referring to FIG. 5, the opening 145 of the ground layer 140 including the defected ground structure (DGS) may expose portions of the microstrip 120. In this connection, a width L12 of the opening 145 measured in the second direction intersecting the first direction in which the micro strip 120 extends may be greater than a width L11 of the micro strip 120 measured in the second direction.

In this connection, the microstrip 120 may be configured to pass through the center of the opening 145. That is, the microstrip 120 and the opening 145 may be arranged to have the same center, and may be arranged to overlap with each other.

The ground layer 140 may include a plurality of opening 145. In this connection, the plurality of the openings 145 may be arranged at regular intervals in the ground layer 140. However, the present disclosure is not limited thereto. The openings 145 may be randomly distributed at non-uniform intervals to define the defected ground structure (DGS).

Referring to FIG. 6, the top face and side faces of the microstrip 120 and the bottom face and side faces of the ground layer 140 may be covered with the liquid-crystal layer 130. Accordingly, the micro strip 120 and the ground layer 140 may be spaced apart from each other, such that the electric field may be generated between the micro strip 120 and the ground layer 140 when the DC voltage is applied to between the microstrip 120 and the ground layer 140. The electric field applied to the liquid-crystal layer 130 may change the dielectric constant of the liquid-crystal layer 130.

In this connection, the DC voltage DC applied to between the microstrip 120 and the ground layer 140 may be lower than or equal to about 25 V to shift the phase of the phase shifter 100 by 360 degrees. This means that in accordance with the present disclosure, a voltage lower than 140V may be applied as a driving voltage for shifting the phase of the phase shifter by 360 degrees, while in the conventional technique, a driving voltage for shifting the phase of the phase shifter by 360 degrees is 140V.

That is, the electromagnetic-wave communication module according to the present disclosure may adjust a sufficient phase angle only using the low applied voltage and may lower the signal loss. Thus, the operation performance and efficiency of the phase shifter 100 can be improved.

Further, a height D2 of the liquid-crystal layer 130 may be smaller than or equal to 10 μm. In addition, a height D1 of the microstrip 120 and a height D3 of the ground layer 140 may be the same or similar to each other. However, this is only an example, and the present disclosure is not limited thereto.

That is, in the electromagnetic wave communication module according to the present disclosure, the thickness of the phase shifter 100 may be reduced by using the thin liquid-crystal layer 130 as compared with the prior art. Thus, using a small amount of liquid crystal may allow the production cost thereof to be reduced.

As shown in FIG. 7, in the phase shifter 100, an A1 region and an A3 region have a relatively large capacitance value in the transmission line, while an A2 region has a relatively large inductance value in the transmission line. In general, the transmission line has a phase delay proportional to a square root of a product between the inductance and capacitance. That is, in the phase shifter 100 including the defected ground structure (DGS), the phase delay is determined by a ratio between a non-opening area and the opening area 145.

However, the dielectric constant of the liquid-crystal layer 130 located between the microstrip 120 and the ground layer 140 may be changed by the DC voltage DC applied to the microstrip 120 and the ground layer 140. This change in the dielectric constant can change the capacitance of the phase shifter 100 and ultimately change the phase shift degree of the phase shifter 100.

As a result, the phase shifter 100 according to the present disclosure changes the magnitude of the DC voltage applied to between the microstrip 120 and the ground layer 140 to allow the degree of the phase shifted by the phase shifter 100 to be changed. Accordingly, the user can freely change the phase angle of the phase shifter 100. When the phase error is caused by an electromagnetic-wave disturbance (e.g., diffraction and interference of the electromagnetic-wave), the phase error may be corrected by changing the angle of the phase.

Further, since the phase shifter 100 according to the present disclosure may allow increasing the transmission line length or increasing the inductance using the defected ground structure (DGS) without or adding other components, the insertion loss of the transmitted signal is not greatly increased.

Figure 8:
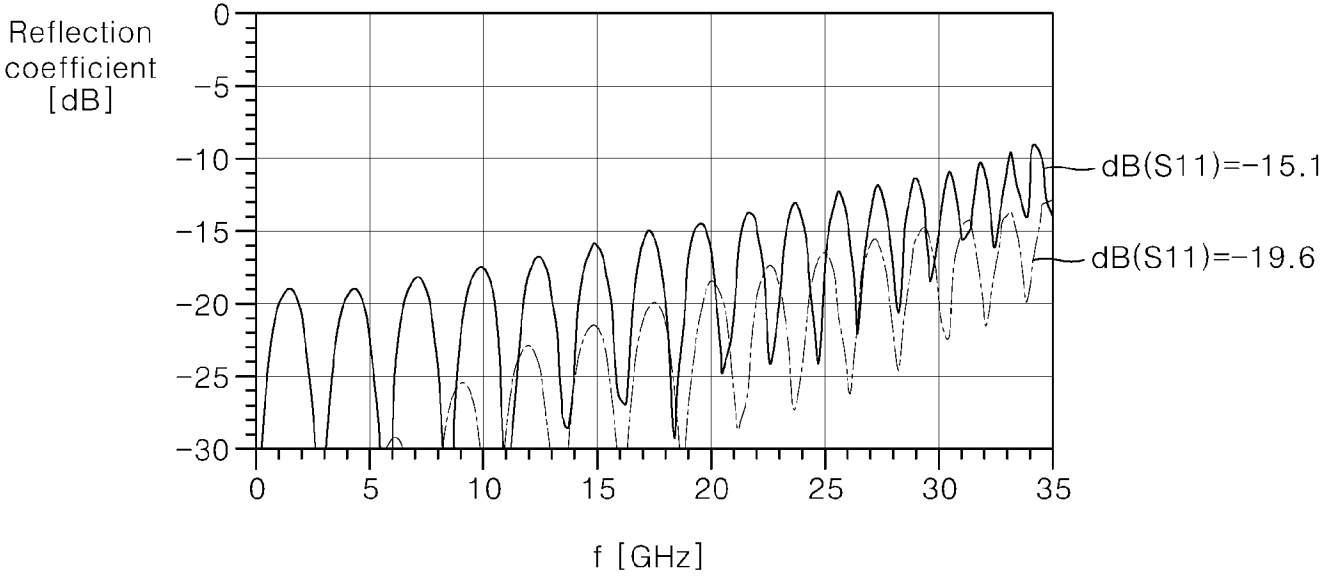
FIG. 8 to FIG. 10 are graphs showing performance of a phase shifter according to one aspect of the present disclosure.
Figure 9:
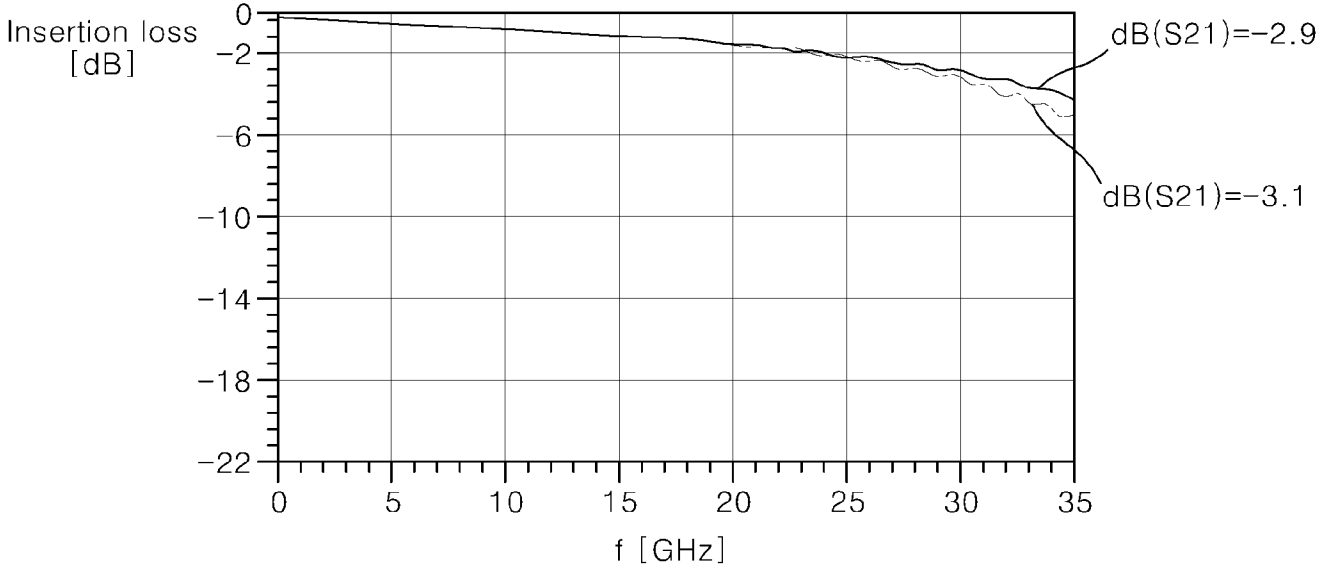
Figure 10:
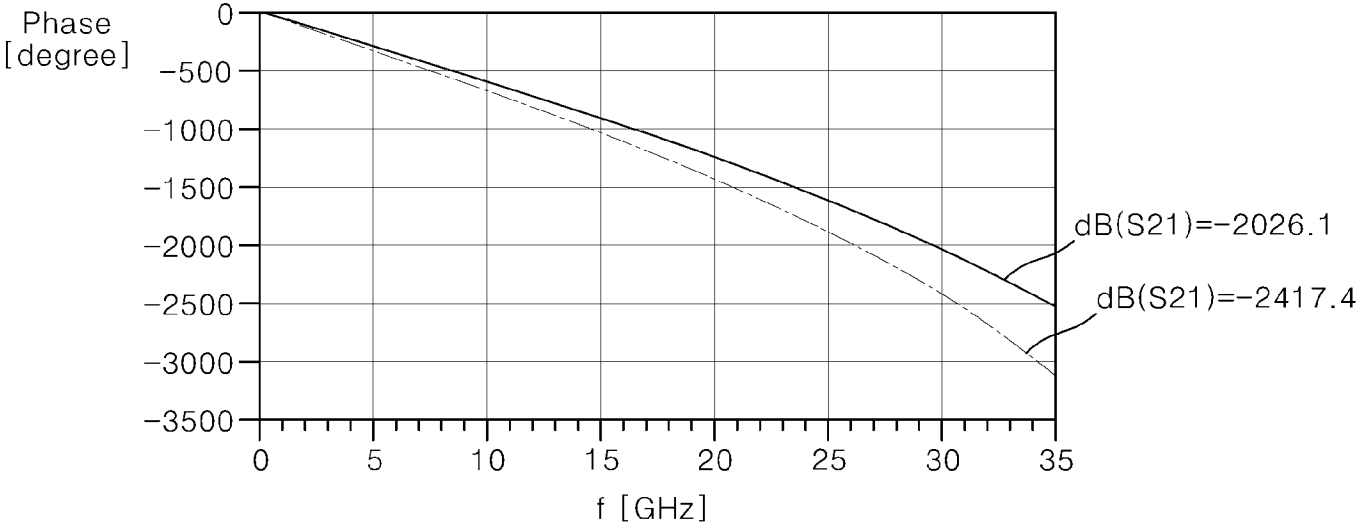

FIG. 8 to FIG. 10 are graphs showing performances of the phase shifter according to one aspect of the present disclosure. Specifically, FIG. 8 shows a relationship between a frequency and a reflection coefficient of the phase shifter 100 according to one aspect of the present disclosure. FIG. 9 shows a relationship between an insertion loss and a frequency of the phase shifter 100 according to one aspect of the present disclosure. FIG. 10 shows a relationship between a frequency and a phase of the phase shifter 100 according to one aspect of the present disclosure.

In this connection, S11 represents an output value of a first port with respect to an input value of the first port. That is, the input port and the output port are the same. S12 represents an output value of a second port with respect to an input value of the first port. Further, in FIG. 8 to FIG. 10, a solid line represents a maximum value of the voltage applied to the liquid-crystal layer 130, that is, represents a maximum permittivity. A dotted line represents a minimum value of the voltage applied to the liquid-crystal layer 130, that is, a minimum permittivity.

Referring to FIG. 8, in the phase shifter 100 according to the present disclosure, a magnitude of a signal reflected to the input port is about 1/100 to 1/80 of a magnitude of a signal applied to the input port (based on 30 GHz).

Referring to FIG. 9, in the phase shifter 100 according to the present disclosure, a magnitude of a signal output to the output port is about half of a magnitude of a signal applied to the input port. This indicates that the magnitude of the loss of the signal is reduced when compared with the phase shifter according to the prior art. In this connection, the insertion loss of 3.1 dB means that about half of the input power is output (based on 30 GHz).

Referring to FIG. 10, in the phase shifter 100 according to the present disclosure, change of a phase of the signal output to the output port from a phase of the signal input to the input port is about 400 degrees. This indicates that the phase change of 360 degrees required for the phase shifter is satisfied.

As described above, the phase shifter according to the present disclosure can reduce the thickness of the phase shifter by using the thinner liquid-crystal layer compared to that of the conventional configuration. Thus, using the small amount of liquid crystal may allow the production cost thereof to be reduced.

Further, the phase shifter according to the present disclosure does not have the limited bandwidth but has a low frequency-pass configuration and has an advantage that the phase shifter may be used in a range of from 0 Hz to 30 GHz. Further, in the phase shifter according to the present disclosure, a total length thereof required to realize a phase difference of 360 degrees is about 1.5 cm. This is advantageous in that the phase shifter may be manufactured in a smaller size than in the prior art, and thus, the electromagnetic-wave communication module may be configured such that all of the antennas are contained in a single chip.

It will be understood by those skilled in the art that various changes in form and details may be made therein without departing from the spirit and scope of the disclosure as defined by the appended claims. Thus, the present disclosure is not limited to the above-described aspects and the accompanying drawings.

What is claimed is:

1. A phase shifter comprising:

a first substrate;

a microstrip disposed above the first substrate and extending in a first direction;

a ground layer disposed above the microstrip and spaced apart from the microstrip, wherein the ground layer includes a defected ground structure (DGS) having a defected pattern;

a second substrate disposed above the ground layer; and a liquid-crystal layer disposed in a space between the first substrate and the second substrate, wherein a direct current (DC) voltage is applied between the ground layer and the microstrip, wherein the top face and side faces of the microstrip and the bottom face and side faces of the ground layer covered with the liquid-crystal layer, wherein a height of the microstrip and a height of the ground layer are the same or similar to each other, wherein the thickness of the liquid crystal layer is greater than the sum of the height of the ground layer and the height of the microstrip, wherein the ground layer includes a plurality of rectangle openings arranged to be spaced from each other at a regular interval in the ground layer and having same width in a second direction intersecting the first direction.

2. The phase shifter of claim 1, wherein the liquid crystal layer includes a liquid crystal material having a dielectric constant changed based on a magnitude of the DC voltage applied between the ground layer and the microstrip.

3. The phase shifter of claim 2, wherein the microstrip is positioned at a center of the opening.

4. The phase shifter of claim 2, wherein a width of the opening measured in a second direction intersecting with the first direction is greater than a width of the microstrip measured in the second direction.

5. The phase shifter of claim 2, wherein at least two opening are arranged to be spaced apart from each other at a regular interval in the ground layer.

6. The phase shifter of claim 1, wherein the defected ground structure includes at least one opening which overlaps with the microstrip and defined by etching.

7. The phase shifter of claim 1, wherein each of the first substrate and the second substrate includes a glass substrate.

8. The phase shifter of claim 1, wherein the ground layer is made of a metal material including copper.

9. The phase shifter of claim 1, wherein a thickness of the liquid-crystal layer is greater than a sum of a thickness of the ground layer and a thickness of the microstrip.

10. An electromagnetic wave communication module comprising:

an antenna array transmitting and receiving an electromagnetic wave;

a phase shifter transmitting a transmitted signal of an alternate current (AC) voltage to the antenna array, wherein the phase shifter is configured to change a phase of the transmitted signal; and a voltage controller configured to control a magnitude of a direct current (DC) voltage applied to the phase shifter, wherein the phase shifter includes:

a first substrate;

a microstrip formed above the first substrate and extending in a first direction;

a ground layer disposed above the microstrip and spaced apart from the microstrip, wherein the ground layer includes a defected ground structure (DGS) having a defected pattern;

a second substrate disposed above the ground layer; and a liquid-crystal layer disposed in a space between the first substrate and the second substrate, wherein the voltage controller is configured to apply the direct current voltage between the ground layer and the microstrip, wherein the top face and side faces of the microstrip and the bottom face and side faces of the ground layer covered with the liquid-crystal layer, wherein a height of the microstrip and a height of the ground layer are the same or similar to each other, wherein the thickness of the liquid crystal layer is greater than the sum of the height of the ground layer and the height of the microstrip, wherein the ground layer includes a plurality of rectangle openings arranged to be spaced from each other at a regular interval in the ground layer and having same width in a second direction intersecting the first direction.

11. The electromagnetic wave communication module of claim 10, wherein the electromagnetic wave communication module further comprises a power distributor receiving a transmitted signal from a DC blocker which removes a DC voltage component and the power distributor distributing the transmitted signal free of the DC voltage component to a plurality of the phase shifters.

12. The electromagnetic wave communication module of claim 11, wherein the antenna array includes a plurality of antennas arranged at regular intervals.

13. The electromagnetic wave communication module of claim 12, wherein the module includes a plurality of phase shifters, and wherein the plurality of phase shifters are arranged to be one-to-one match between the plurality of phase shifters and the plurality of antennas.

14. The electromagnetic wave communication module of claim 10, wherein the liquid-crystal layer includes a material having a dielectric constant varying according to a magnitude of the DC voltage applied between the ground layer and the microstrip.

15. The electromagnetic wave communication module of claim 14, wherein the magnitude of the DC voltage applied to the phase shifter is lower than 25 V and higher than 0 V.

16. The electromagnetic wave communication module of claim 10, wherein the defected ground structure includes at least one opening which overlaps with the microstrip and defined via etching.

17. The electromagnetic wave communication module of claim 16, wherein the microstrip is positioned at a center of the opening.

18. The electromagnetic wave communication module of claim 16, wherein a width of the opening measured in a second direction intersecting with the first direction is greater than a width of the microstrip measured in the second direction.

19. The electromagnetic wave communication module of claim 10, wherein the voltage controller is configured to adjust the magnitude of the DC voltage applied to the phase shifter to change a dielectric constant of the liquid crystal layer.

20. The electromagnetic wave communication module of claim 10, wherein a thickness of the liquid crystal layer is smaller than 10 μm and larger than 0 μm.

* * * * *